US006708467B2

(12) United States Patent
Antonelli et al.

(10) Patent No.: US 6,708,467 B2
(45) Date of Patent: Mar. 23, 2004

(54) ENVELOPE MOISTENER WITH TEMPERATURE ADJUSTING APPARATUS

(75) Inventors: Nicholas Antonelli, Danbury, CT (US); David R. Auerbach, West Redding, CT (US); Al Viglione, Clinton, CT (US); Luciano Dos Santos, Danbury, CT (US)

(73) Assignee: Pitney Bowes Inc., Stamford, CT (US)

( * ) Notice: Subject to any disclaimer, the term of this patent is extended or adjusted under 35 U.S.C. 154(b) by 31 days.

(21) Appl. No.: 09/981,445

(22) Filed: Oct. 17, 2001

(65) Prior Publication Data

US 2003/0070400 A1 Apr. 17, 2003

(51) Int. Cl.[7] ..... B65B 55/10; B43M 5/02

(52) U.S. Cl. ..... 53/479; 53/431; 156/441.5; 493/266; 493/264

(58) Field of Search ..... 53/431, 460, 463, 53/376.5, 374.4, 479; 156/441.5, 442.2, 442.4; 493/264, 265, 266, 332

(56) References Cited

U.S. PATENT DOCUMENTS 3,821,875 A * 7/1974 Paxton ..... 53/376.5
3,902,406 A * 9/1975 Reichert ..... 93/36 MM
3,905,325 A 9/1975 Labore et al.
4,228,634 A 10/1980 Savit
4,589,950 A * 5/1986 Sekavec, Jr. ..... 156/578
5,006,194 A * 4/1991 Schmaling ..... 156/442.1
5,056,297 A * 10/1991 Fallos ..... 53/482
5,674,348 A * 10/1997 DeFiguerido ..... 156/441.5
5,770,005 A * 6/1998 Staniszewski ..... 156/442.1
5,807,463 A * 9/1998 Boughton ..... 156/441.5
5,840,123 A * 11/1998 Holbrook ..... 118/603
6,413,315 B1 * 7/2002 Hendricks ..... 118/222

* cited by examiner

*Primary Examiner*—Rinaldi I. Rada
*Assistant Examiner*—Gloria Weeks
(74) *Attorney, Agent, or Firm*—Michael J. Cummings; Charles R. Malandra, Jr.; Angelo N. Chaclas

(57) ABSTRACT

A method and system for moistening and sealing an envelope in a high speed mail processing machine including steps and components for heating a liquid to moisten the glue on the envelope flaps to more quickly soften the glue and provide an improved seal.

20 Claims, 2 Drawing Sheets

ENVELOPE MOISTENER WITH TEMPERATURE ADJUSTING APPARATUS

TECHNICAL FIELD

The present invention generally relates to an apparatus for moistening the flap of an envelope in a high speed mail processing machine, and more particularly to heating the liquid used for moistening envelope flaps in such a machine.

BACKGROUND OF THE INVENTION

In mail processing machines, moistening devices are used to wet the flap of an envelope in preparation for sealing the envelope. Conventionally, flap wetting is accomplished by feeding the envelopes flaps past a moisture applicator such as a brush, a wick, or other moist surface, allowing the moist surface to come into contact with the glue on the envelope flap. The moisture causes the glue to soften and to become sticky. The moistened envelopes flaps are closed and the glue is pressed between the flap and the body of the envelope to form a seal. The envelope is then either ejected into a stacker, or passed on to another part of the mail processing machine for further processing.

Current mail processing machines are often required to process up to 18,000 pieces of mail an hour, and envelopes travel at speeds as high as 100 inches per second as they are being processed. As a result, the steps of moistening and sealing the envelope flaps must occur very quickly. In such a high speed environment, conventional moistening and sealing devices can result in a poor seal because the glue has inadequate time to absorb enough moisture before the flap is closed. In high speed systems, moisture may not have time to penetrate and fully moisten glue to allow an effective seal. If the envelope flap is closed before the glue is adequately softened, the flap may partially or fully open during further high speed processing, and possibly jam the machine.

Also, with envelope flaps moving by the moistening applicators so quickly, there is less time for water to flow from the applicator to the envelope flap. Thus it is desirable to facilitate the flow of water out of the applicator to ensure that adequate moisture is applied to the glue on the envelope flaps.

SUMMARY OF THE INVENTION

The present invention provides an envelope moistening and sealing system in which the liquid used to moisten the glue on the envelope flaps is heated. The heated liquid softens the glue more quickly, providing an improved seal for an envelope in a high speed mail processing machine. In the preferred embodiment, the heating element can be molded directly into the walls of the reservoir tank.

The reservoir is also adapted to control the liquid level by feeding liquid in through an inlet, and draining liquid out via an outlet drain located at the desired liquid level. The flow of liquid from the inlet to the drain serves to refresh the liquid in the reservoir and to slow the accumulation of biological material in the reservoir. The reservoir is also equipped with a splash receptacle around the perimeter of the reservoir to retain liquid that might splash out of the main reservoir volume when the machine is moved or bumped.

The heating element of the system can also be adapted for use as a low liquid sensor by monitoring the rate at which the heating element heats. If there is little or no liquid in the system, the heating element overheats or heats more quickly and a low liquid alarm is activated.

DETAILED DESCRIPTION

Figure 1:
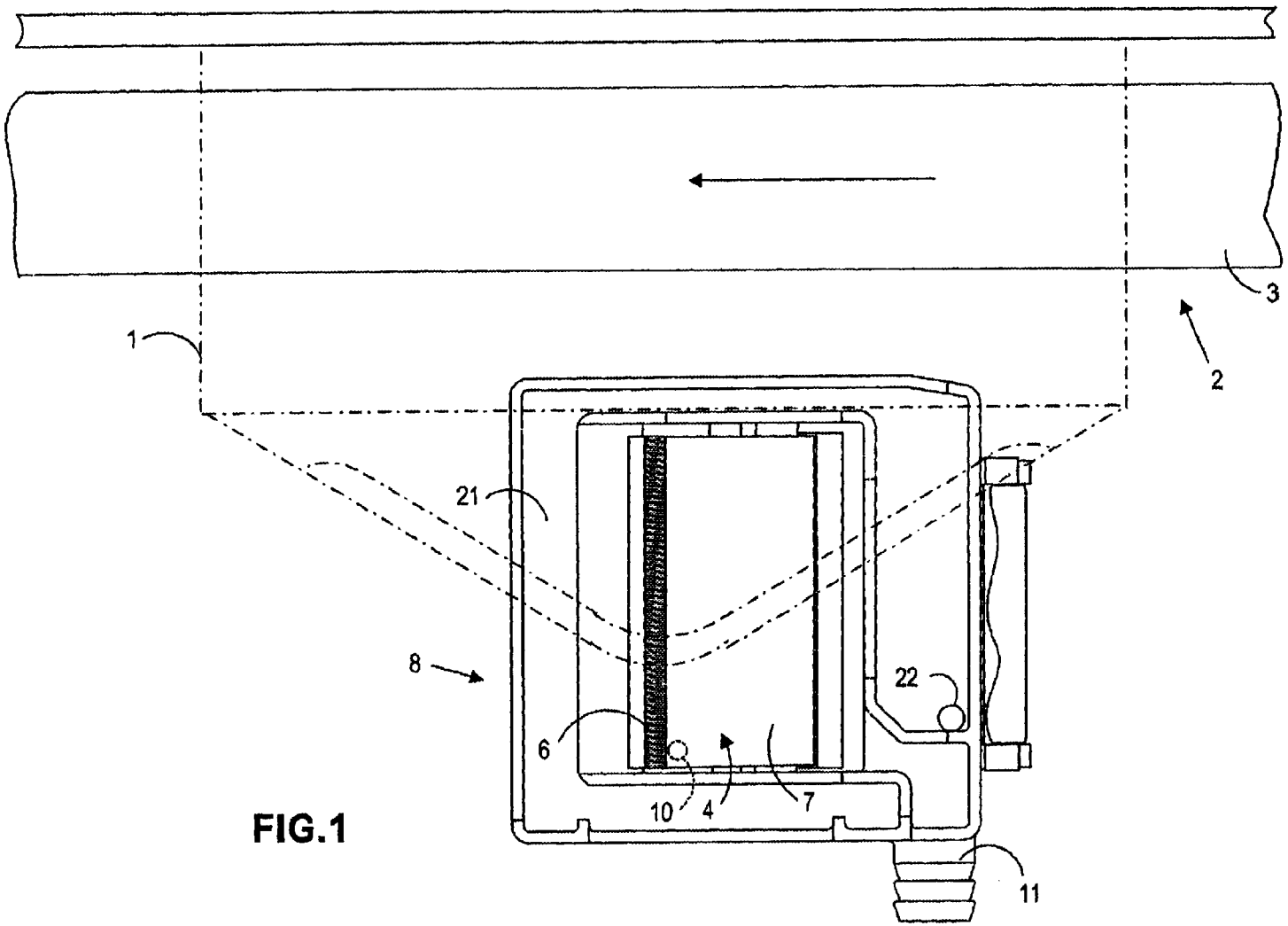
FIG. 1 is a top view of a preferred embodiment of the system for moistening envelope flaps.
Figure 2:
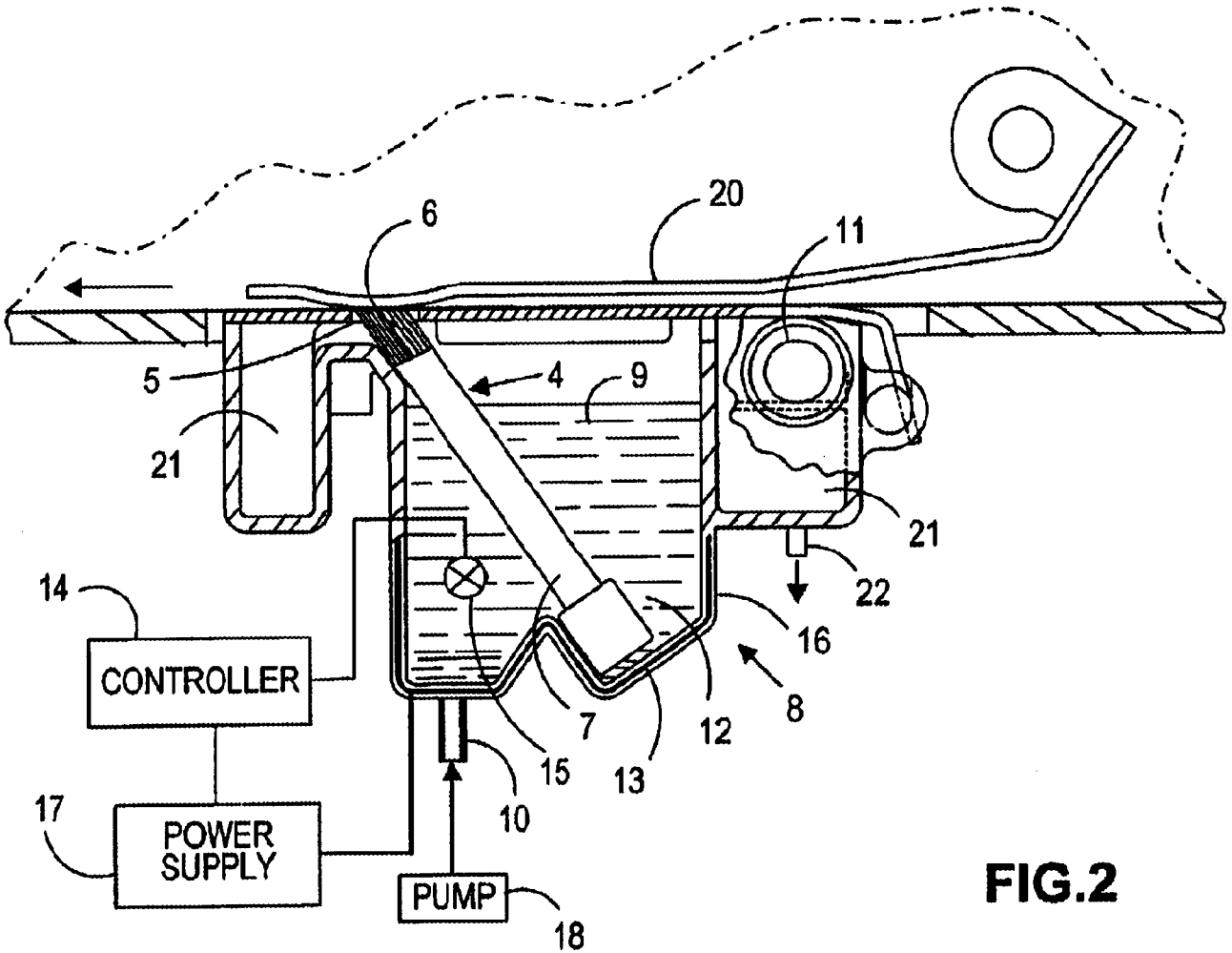
FIG. 2 is cross sectional side view of a preferred embodiment of the system for moistening envelope flaps.

A preferred embodiment of the envelope flap moistening system can be seen in FIGS. 1 and 2. An envelope 1 is transported through the flap moistening system via a transport mechanism 2. Transport mechanism 2 typically may include transport belts 3 between which envelope 1 is fed in a downstream direction. As the envelope 1 is transported by belts 3, the open flap of the envelope 1 passes over the moistening arrangement. As the envelope 1 passes through the flap moistening system, the glued portion of the envelope flap is passed over a moisture applicator 4. The moisture applicator 4 comes into contact with the glue on the envelope flap, moisture is transferred from the applicator 4 to the flap, and glue on the flap softens.

To ensure that the envelope flap makes good contact with the moisture applicator 4, a depressor member 20 is positioned above the moisture applicator. Depressor member 20 is generally a flat plate, the upstream end of which is pivotally attached to a structure above the moistening system. Depressor member 20 may be spring biased to provide a normal force urging envelope flaps that pass beneath it in a downward direction. The normal force of the depressor member 20 causes the envelope flap to come into firm contact with the moisture applicator 4.

In the system depicted in FIGS. 1 and 2, the envelope 1 is transported through the system in a horizontal position, with the envelope body and flap being co-planar. The envelope may be transported and moistened in alternative orientations and positions. For example, the envelope may be transported and moistened while in a vertical open position. Or, the envelope may be vertical, while flap extends perpendicular and horizontally while it is passed through the moistening system.

After the envelope 1 passes the flap moistening system, it is transported downstream to any conventional flap closing mechanism. Such a flap closing mechanism typically comprises a curved blade (not shown) for diverting the flap into a closed position as the envelope passes by the blade. When the flap is closed, the envelope 1 may further be passed through a set of rollers (not shown) to ensure that it is evenly and firmly sealed. After the envelope is closed and sealed, it can be ejected into an envelope stacker (not shown), or passed to another part of the mail processing system, such as a weighing postage metering device (not shown).

Moisture applicator 4 is preferably a brush 6. Brush 6 has bristles that extend into a optional brush base 7 that supports and contain the bristles. Brush 6 extends downward at an oblique angle into the reservoir 8. The bristles of brush 6 are preferably made from nylon and are crimped together using a ferrule. The brush base 7 is preferably made from plastic and is open to allow liquid in the reservoir 8 to come into contact with the bristles contained therein.

Reservoir 8 is a container, preferably made from plastic or polymer material. The reservoir stores moistening fluid 9. In the preferred embodiment liquid is slowly circulated through the reservoir 8. Liquid enters the reservoir via inlet 10 at a bottom portion of the reservoir. Preferably, liquid is slowly pumped by a diastolic pump 18, or other suitable pump, into the reservoir 8 through inlet 10. Reservoir 8 includes an outlet drain 11 at the desired liquid level on a sidewall of the reservoir 8. Thereby, when the liquid is at the desired level, and additional liquid is pumped in through inlet 10, excess liquid flows out of drain 11. In the preferred embodiment, liquid is pumped into the reservoir 8 at a rate slightly greater than the rate needed to replace liquid used for moistening envelope flaps, and lost from evaporation. The small amount of extra liquid serves to create a low rate flow from the inlet 10 to the outlet 11 that helps to inhibit the growth of biological material in the reservoir 8.

In the preferred embodiment, the reservoir 8 is surrounded by a splash receptacle 21 around its perimeter. The splash receptacle 21 serves retain liquid which might slosh or splash out of the reservoir volume when the machine is moved or bumped. Liquid that sloshes out of the reservoir 8 may then drip back into the splash receptacle 21, instead of getting other components wet. Splash receptacle 21 may be integrally formed with the reservoir 8, as shown in FIGS. 1 and 2, or it may be formed as a separate component. Splash receptacle 21 also includes a drain 22 from which liquid may drained to a disposal area, or to be reintroduced into the cycle through reservoir 8.

The moistening brush 6 protrudes through a hole 5 in the top of the reservoir 8. The brush 6 extends downwardly from the hole 5 at an oblique angle into the reservoir 8, and preferably a substantial portion of the brush 6 is submerged in fluid stored in the reservoir 8. In the preferred embodiment, the wall of the reservoir 8 can form a channel 12 for receiving and holding a lower portion of the brush in the desired position. Fluid is absorbed and propagated among the submerged bristles, moistening the entire brush 6.

As an alternative to a bristled brush 6, the moisture applicator 4 may be made in any conventional manner. For example, a porous synthetic sponge material may be used instead of bristles, for absorbing and transferring fluid from the reservoir to envelope flaps.

An important aspect of the present invention is the means by which the fluid in the reservoir 8 is heated to assist in the moistening of envelopes 1 passing through the system. To this end, a heater element 13 is included in the reservoir 8.

The heater element 13 can be integrally molded into the plastic or polymer material comprising a lower portion 16 of the wall structure of the reservoir 8. The heater 13 element may be a conductor having a high electrical resistance. In a preferred embodiment of the invention, the lower portion 16 of the reservoir wall structure may itself be a heater 13 comprising a molded polymer composite heater with a polymer composite core, an electrically conductive heating element disposed about the core, and a molded thermally conductive polymer composite sheath surrounding the heating element.

Such polymer composite materials for use in heaters are known, for example as described in U.S. Pat. No. 6,124,579, entitled Molded Polymer Composite Heater. A molded polymer composite heater, as described in that patent, allows the structure if the lower portion 16 of the reservoir to serve as both a wall for containing fluid in the reservoir, and as a heater for keeping the fluid warm.

As an alternative to molding the heater element 13 into the walls of the reservoir 8, a conventional heating unit may be separately situated within the volume of the reservoir 8. Such a heater could be mounted anywhere within the submerged region of the reservoir and would be connected to a power source via conductors passing through the wall of the reservoir 8.

An electrical current is applied to the heater element 13 to warm the liquid in the reservoir 8. In one embodiment of the invention, a predetermined amount of electrical energy is supplied from power supply 17 to the heater element 13 to achieve a temperature in a desired range. Based on the characteristics of the reservoir 8, the characteristics of the liquid in the reservoir, and the heat conductive properties of the heater, a steady state temperature within a desired range can be achieved by applying a predetermined electrical current/voltage to the heater element 13.

In another embodiment, a more sophisticated system for controlling the heater may be employed. Electrical current can be supplied to the heater from a power supply 17 coupled to a heater controller 14. Heater controller 14 is further coupled to a temperature sensor 15 that is located within the reservoir 8. The temperature sensor 15 may be mounted at any location within submerged region of the reservoir 8. The temperature sensor 15 may also be mounted within the wall structure of reservoir 8.

The heater controller 14 can be programmed to maintain a predetermined reservoir fluid temperature. The controller 14 receives a fluid temperature signal from the temperature sensor 15. If the controller 14 senses that fluid has dropped below a minimum temperature threshold, then an electrical current is applied to the heater 13 to raise the temperature. When the controller 14 detects that the fluid has reached an upper temperature threshold, the heater 13 is deactivated. In the preferred embodiment, the temperature of the fluid is maintained at a temperature ranging from 90 to 100 degrees Fahrenheit.

The arrangement of the heater 13 and temperature control 14 described herein may also serve to detect a low liquid level in the reservoir 8. As the level of liquid in the reservoir 8 decreases, it will take less time for the heater to heat the liquid to its desired temperature. Accordingly, a low liquid level event can be detected by monitoring the temperature sensor 15 and timing how long it takes to heat the reservoir to the predetermined temperature. Alternatively, instead of monitoring the temperature sensor, the period for which the heater 13 is "on" can be monitored. If the heating time is less than a predetermined minimum, then a liquid level low signal may be generated an appropriate or indication generated.

A further method of sensing low liquid level relies on monitoring the flow of electricity to the heater 13. If little or no liquid were present to absorb heat load of the heater element, the element well heat up, and its resistance characteristics will change. Accordingly a change in the electrical current flowing to the heater can be detected, and if the change is greater than a threshold value, a liquid low level signal can be generated.

While preferred embodiments of the invention have been described and illustrated above, it should be understood that these are exemplary of the invention and are not to be considered as limiting. Additions, deletions, substitutions, and other modifications can be made without departing from the spirit or scope of the present invention. Accordingly, the invention is not to be considered as limited by the foregoing description but is only limited by the scope of the appended claims.

What is claimed is:

1. A system for moistening dried glue on an envelope flap and sealing envelopes comprising:

an envelope transport;

a moisture applicator proximal to the envelope transport, the moisture applicator positioned for applying moisture to the flap of an envelope on the envelope transport;

a reservoir coupled to the moisture applicator; and a heater for raising the temperature a moistening liquid in the moisture applicator.

2. The system of claim 1 wherein the temperature is raised to be between 90 and 100 degrees Fahrenheit.

3. The system of claim 1 wherein the reservoir further comprises:

an inlet for receiving liquid into the reservoir; and a drain located at a desired liquid level.

4. The system of claim 3 further comprising:

a pump coupled to the reservoir inlet for pumping liquid into the reservoir and causing liquid in the reservoir to rise to the desired liquid level and to flow out of the reservoir via the drain.

5. The system of claim 1 further comprising:

a splash receptacle located substantially around the perimeter of the reservoir.

6. The system of claim 1, wherein the heater is located in the reservoir.

7. The system of claim 6, wherein the heater is molded into the reservoir's structure.

8. The system of claim 7, wherein at least a portion of the reservoir structure is comprised of a composite polymer material and the heater is molded into the composite polymer material.

9. The system of claim 8 wherein the composite polymer portion of the reservoir structure comprises a substantial portion of the reservoir structure for containing liquid.

10. The system of claim 1 further comprising an envelope flap closing mechanism proximal the envelope transport and downstream from the moisture applicator.

11. The system of claim 1 wherein the heater is electrical and further comprising a heater power supply monitor for monitoring electrical power to the heater, the heater power supply monitor generating a liquid low signal upon detecting a predetermined change in the electrical power being supplied to the heater.

12. The system of claim 1 further comprising:

a temperature sensor for sensing the temperature of said moistening liquid in the system; and a temperature controller coupled to the temperature sensor, and controlling the heater to maintain a predetermined temperature of said moistening liquid in the system.

13. The system of claim 12 wherein the predetermined temperature is in a range from 90 to 100 degrees.

14. The system of claim 12 wherein the temperature controller generates a moistening liquid low signal if the heater heats more quickly than a predetermined maximum heating rate.

15. A method for moistening dried glue on an envelope flap and sealing an envelope in a mail processing machine comprising the steps of:

transporting an envelope along an envelope processing path;

heating a moistening liquid;

applying the heated liquid to the open flap of the envelope as it is transported along the envelope processing path; and closing the envelope flap after applying the heated liquid.

16. The method of claim 15 further comprising:

storing the moistening liquid in a reservoir; and inducing a flow of moistening liquid from a reservoir inlet to a reservoir outlet, to prevent a build up of biological material.

17. The method of claim 15 further comprising:

sensing the temperature of the moistening liquid;

and the step of heating includes heating the moistening liquid to a predetermined temperature.

18. The method of claim 17 wherein the predetermined temperature is in a range from 90 to 100 degrees Fahrenheit.

19. The method of claim 15 further comprising:

sensing a rate of heating by the heating element; and generating a liquid low signal if the rate of heating is faster than a predetermined maximum heating rate.

20. The method of claim 15 further comprising molding a heating element into a reservoir for holding the moistening liquid.

* * * * *